United States Patent [19]

Yasutome et al.

[11] 4,090,102

[45] May 16, 1978

[54] COVER GLASS STRUCTURE OF FLAT TYPE INDICATOR TUBE

[75] Inventors: Osamu Yasutome, Taishi; Mitsuo Takeda, Tokyo; Yasumasa Mori, Hyogo; Tagayasu Sawamura, Himeji, all of Japan

[73] Assignee: Tokyo Shibaura Electric Co., Ltd., Kawasaki, Japan

[21] Appl. No.: 765,424

[22] Filed: Feb. 3, 1977

[51] Int. Cl.[2] ..... H01J 5/24; H01J 7/22; H01J 19/58; H01J 19/72

[52] U.S. Cl. ..... 313/317; 313/220; 313/497; 313/519

[58] Field of Search ..... 313/496, 497, 513, 519, 313/220, 317

[56] References Cited

U.S. PATENT DOCUMENTS

| | | | |
|---|---|---|---|
| 3,821,584 | 6/1974 | Scovroner | 313/220 X |
| 3,976,823 | 8/1976 | Ernsthausen | 313/220 X |
| 4,020,386 | 4/1977 | Yasutome et al. | 313/496 |

FOREIGN PATENT DOCUMENTS

| | | | |
|---|---|---|---|
| 2,517,161 | 2/1976 | Germany | 313/220 |

*Primary Examiner*—Palmer C. Demeo

*Attorney, Agent, or Firm*—Cushman, Darby & Cushman

[57] ABSTRACT

A flat type indicator tube is provided with a box-like cover glass on a substrate. The cover glass forms an air tight space together with the substrate. In the space, there are provided display sections each consisting of a plurality of anode segments disposed on the substrate, grid and cathode electrodes provided above the display sections. The cover glass is comprised of a flat major section, a side wall and a flange section. The flange section comprises a flat flange contacting the substrate through glass frit and a coupling portion so shaped as to receive one end portion of the exhaust tube therein. A projection is formed on and substantially perpendicular to the inner wall of the coupling portion of the flange section. The projection is contacted and serves to restrict undesired excessive insertion of the exhaust tube into the coupling portion. The exhaust tube is hermetically fixed between the coupling portion and the substrate through glass frit.

2 Claims, 5 Drawing Figures

COVER GLASS STRUCTURE OF FLAT TYPE INDICATOR TUBE

BACKGROUND OF THE INVENTION

The present invention relates to improvements of a cover glass structure of a flat type fluorescent indicator tube.

As well known, the flat type fluorescent indicator tube is generally comprised of a substrate, display sections each consisting of a plurality of anode segments disposed on the substrate for displaying alphanumeric characters, a cathode filament stretched above and across those display sections, a box-like glass envelope or cover glass disposed on the substrate for hermetically enclosing the display sections and the cathode filament disposed, connecting means extending to the outside of the glass envelope with connection to the anode segments and the cathode filament, and a exhaust tube sandwiched between the glass envelope and the substrate and communicating with the space defined by the glass envelope and the substrate. The exhaust tube which is generally tubular is fitted at one end in the side wall of the glass envelope with the other end sealed. The other end of the exhaust tube is opened when the exhaust tube is fitted to the glass envelope and is sealed after the space in the glass envelope has been evacuated through the exhaust tube. The side wall of the glass envelope is provided with a coupling portion so shaped as to permit the exhaust tube to be fixedly received therein.

Generally, one end portion of the exhaust tube is placed in the coupling portion of the glass envelope and then the gap between the exhaust tube and the coupling portion is filled with glass frit to glue the exhaust tube to the glass envelope into a integral form. Then, the glass envelope with the exhaust tube fixed thereto is secured onto the substrate by using a glass frit. Alternately, the exhaust tube is placed on the substrate and then glass envelope is placed on the same with the exhaust tube with an alignment of the coupling portion of the glass envelope with the exhaust tube on the substrate. Following this, those elements are integrally glued together by using frit glass. In assembling, the exhaust tube frequently damages the anode segments disposed on the substrate or the cathode filament stretched above the substrate. Further, the connection of the exhaust tube with the glass envelope is often insufficient so that an air leak tends to occur. Several attempts have been made to overcome those defects. For example, specially devised instrument has been used to align the exhaust tube with the glass envelope; however, the result is poor.

The glass envelope is transparent and flat in order that the alphanumeric characters can be seen from the exterior without any distortion. However, while the coupling portion is formed on the side wall of the glass envelope, the flat glass envelope is distorted and the distorted alphanumeric characters which are displayed by the anode segments are seen through the distorted glass envelope. The distortion of the glass envelope arises from the fact that, in the assembling process of the glass envelope, while the coupling portion is formed by means of softing a flat glass, the compression exerting on the coupling portion of the softened glass envelope is carried to the flat portion of the glass envelope on the display sections, resulting in the distortion thereof.

SUMMARY OF THE INVENTION

Accordingly, an object of the present invention is to provide a cover glass of a flat type indicator tube permitting an exhaust tube to reliably be fitted thereto.

Another object of the present invention is to provide the cover glass of the flat type indicator tube in which the exhaust tube is placed on a predetermined position between the cover glass and the substrate without any damage of various components on the substrate.

Other object of the present invention is to provide a cover glass structure of the indicator tube, having a flat portion through which the display section can be seen without any distortion.

The present invention may be briefly summarized as a flat type indicator tube comprising a substrate provided thereon with a display section consisting of a plurality of anode segments, a cover glass disposed on the substrate and to form, together with the substrate, a hermetically sealed space for accommodating the display section and a cathode stretched above and across the display section, a coupling portion which is integral with the cover glass and projects outwardly with the cover glass, a projection which is integral with the coupling section and is formed on the inner base portion of the coupling portion and an exhaust tube which is hermetically and fixedly supported between the coupling section and the substrate with one end thereof contacting the projection and the other end thereof being sealed.

Other objects and features of the present invention will be apparant from the following description in connection with the accompanying drawings, in which:

DESCRIPTION OF THE PREFERRED EMBODIMENTS

Figure 1:
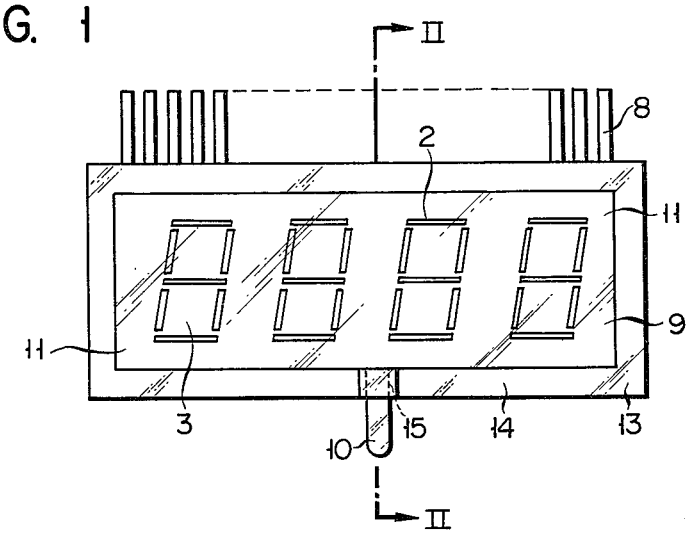
FIG. 1 is a plan view of a flat type indicator tube of an embodiment of the present invention.
Figure 2:
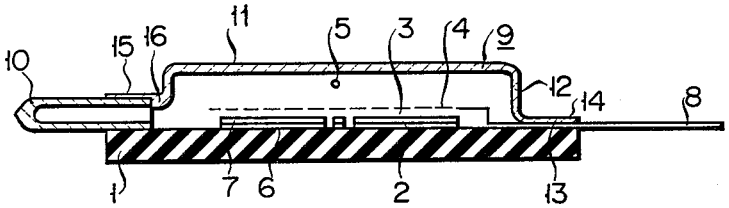
FIG. 2 is an enlarged cross sectional view, as taken along line II—II, showing a flat type indicator tube in FIG. 1.
Figure 3:
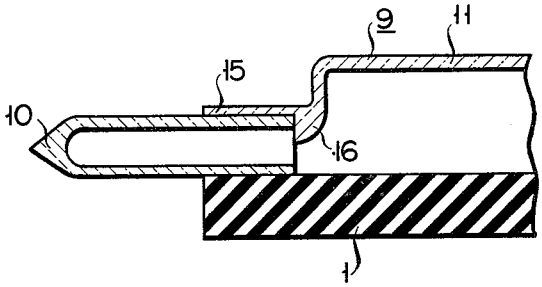
FIG. 3 is an enlarged cross sectional view of a major portion of the indicator tube according to the present invention.
Figure 4:
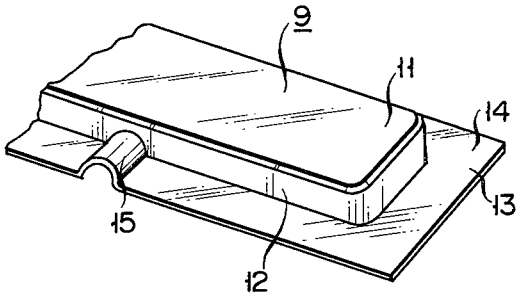
FIG. 4 is a perspective view showing the cover glass of the indicator tube partly broken away in FIG. 1.

Reference will now be made to FIGS. 1 and 2. As shown, a flat type indicator tube comprises a substrate 1, four display sections 3 each consisting of anode segments 2 arranged in the digit "8" shape on the substrate 1, grid electrodes 4 and a cathode 5. Each of the anode segments 2 is made of an anode electrode 6 disposed on the substrate and fluorescent layer 1 disposed on the anode electrode 6. Each grid electrode 4 is disposed above each anode segment 2 in spaced relation and the cathode 5 is disposed further above and across those grid electrodes 4. Lead wires 8 are further included in this indicator tube, being electrically connected with the anode, cathode and grid electrodes, respectively. A box like cover glass 9 is airtightly fitted to the substrate 1 through glass frit, hermetically enclosing the anode segments 2, grid electrodes 4 and the cathode electrode 5 therein. One end portion of an exhaust tube 10 is fitted between the cover glass 9 and the substrate 1. The cover glass 9 includes a flat major section 11, a side wall 12 and a flange 13 having a flat portion 14 and a coupling portion or curved portion 15 "U" shaped in cross section. The exhaust tube 10 is made of cylindrical glass and is received into the space defined by the coupling portion 15 and the substrate 1. The flat flange 14 is in contact with the substrate 1. The coupling portion 15 couples the exhaust tube 10 with the indicator tube proper including the cover glass and the substrate and, thus, it is so shaped to receive the exhaust tube. A projection or stepped portion 16 is formed along the corner line where the side wall 12 and the coupling portion 15 are conjoined and substantially perpendicular to the inner wall of the coupling portion 15. The projection 16 serves as a stopper to the exhaust tube 10. When the exhaust tube is inserted in the space between the coupling portion 15 and the substrate 1, it is stopped at the projection 16 and thus prevented from entering the space defined by the cover glass 9 and substrate 1. This is very important for the following reason. If the exhaust tube enters the space, it frequently damages the anode segments 2 on the substrate 1. The provision of the projection 16 eliminates such a defect. The projection 16 may easily be molded by shaping a recess at the corresponding portion of the dies to be used (not shown).

Figure 5:
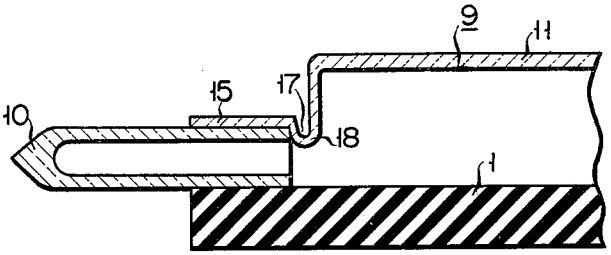
FIG. 5 is an enlarged cross sectional view of another emnbodiment of the present invention.

Turning now to FIG. 5, there is depicted a modification of embodiment shown in FIG. 2.

A projection or stepped portion 16 as shown in FIG. 2 is provided by projecting the inner base portion of the coupling section 15. As shown in FIG. 5, however, a linear groove 17 may be provided at a boundary portion between the coupling section 15 and the flat major section 11 so that the inner surface of the coupling portion 15 is curved and linearly projected toward the interior of the indicator tube. The projection or curved portion 18 as shown in FIG. 5 not only acts as a position regulating member or stopper for the tube 10, but also serves to prevent deformation of the cover glass during the manufacture of the cover glass 9. The cover glass is usually formed by disposing a flat glass on the molded die and softening it. While a coupling portion 15 of the cover glass 9 is formed, a compression on the coupling portion 15 is normally carried to the flat surface of the cover glass 9 due to the coupling section being curved, not flat, tending to cause flat surface portion of the cover glass which is near to the coupling section 15 to be deformed. According to this invention, however, the base portion of the coupling section 15 is recessed to provide a groove 17 at the outer surface and a projection 18 on the inner surface. This structure absorbes the compression on the coupling section 15, substantially preventing the flat surface of the cover glass from being deformed.

From the foregoing description, it will be understood that, with such construction of the indicator tube, the exhaust tube may reliably be fitted to an accurate position between the cover glass 9 and the substrate 1 with hermetic seal and without any damage of the anode segments, even if any type of the manufacturing method of the indicator tube is employed. Since no deformation is formed on the flat surface of the cover glass, the display section on the substrate can be correctly seen through the cover glass.

What we claim is:

1. A flat type indicator tube comprising:

a substrate;

a display section including a plurality of anode segments disposed on said substrate;

a cathode stretched above and across said display section;

a box-like cover glass disposed on said substrate to form a hermetically sealed space for accommodating said display section and said cathode therein;

a coupling portion integral with said cover glass which extends outwardly from the side wall of said cover glass;

a projection formed by inwardly recessing the base portion of the coupling portion; and an exhaust tube which is received in said coupling portion and is hermetically fixed between said coupling portion and said substrate, with one end thereof contacting said projection and the other end thereof being sealed.

2. A flat type indicator tube according to claim 1, in which said cover glass includes a flange portion outwardly extended and contacting said substrate, and said coupling portion is a part of said flange portion.

* * * * *